US009814340B2

(12) United States Patent
Hansen et al.

(10) Patent No.: US 9,814,340 B2
(45) **Date of Patent: *Nov. 14, 2017**

(54) HANGER

(71) Applicant: Hangers Plus, LLC, Coopersville, MI (US)

(72) Inventors: James Hansen, Coopersville, MI (US); Russell O. Blanchard, Zeeland, MI (US)

(73) Assignee: Hangers PLUS, LLC, Coppersville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,887

(22) Filed: Sep. 19, 2016

(65) Prior Publication Data

US 2017/0000278 A1 Jan. 5, 2017

Related U.S. Application Data

(63) Continuation-in-part of application No. 14/864,670, filed on Sep. 24, 2015, now Pat. No. 9,445,679.

(60) Provisional application No. 62/055,812, filed on Sep. 26, 2014.

(51) Int. Cl.

| | |
|---|---|
| ***A41D 27/22*** | (2006.01) |
| ***A47G 25/40*** | (2006.01) |
| ***A47G 25/32*** | (2006.01) |

(52) U.S. Cl.

CPC ..... *A47G 25/40* (2013.01); *A47G 25/32* (2013.01); *A47G 25/4015* (2013.01)

(58) Field of Classification Search

CPC ..... A47G 25/32; A47G 25/325; A47G 25/40

USPC ..... 223/85, 94, DIG. 4

See application file for complete search history.

(56) References Cited

U.S. PATENT DOCUMENTS

| | | | | | |
|---|---|---|---|---|---|
| 3,451,601 | A * | 6/1969 | Ioviero | A47G 25/32 | 223/85 |
| 3,790,046 | A * | 2/1974 | Rooney | A47G 25/50 | 223/92 |
| 3,860,154 | A * | 1/1975 | Atkins | A47G 25/183 | 211/113 |
| 4,168,791 | A * | 9/1979 | Clark, Jr. | A47G 25/50 | 223/94 |
| 5,085,357 | A * | 2/1992 | Chen | A47G 25/4038 | 223/85 |
| 6,000,587 | A * | 12/1999 | Sackett | A47G 25/32 | 223/85 |
| 2008/0283558 | A1 * | 11/2008 | Rude | A47G 25/32 | 223/94 |

(Continued)

*Primary Examiner* — Nathan Durham

(74) *Attorney, Agent, or Firm* — The Watson I.P. Group, PLC; Jovan N. Jovanovic; Vladan M. Vasiljevic

(57) ABSTRACT

A hanger comprising a hanger body and a hook assembly. An attachment assembly is configured to allow for the coupling of the hanger body and the hook assembly in selectively rotatable engagement. The attachment assembly includes a first coupling component and a second coupling component, the first coupling component positioned on the hook assembly and the second coupling component positioned on the hanger body. A releasable locking component releasably where employed locks the first coupling component and the second coupling component in at least a collapsed configuration and an articulated configuration. A loop member may extend from the attachment assembly.

16 Claims, 12 Drawing Sheets

(56) References Cited

U.S. PATENT DOCUMENTS

2009/0283556 A1* 11/2009 Ho ..... A47G 25/32
223/85
2012/0241481 A1* 9/2012 Merandi ..... A47G 25/32
223/85

* cited by examiner

HANGER

CROSS-REFERENCE TO RELATED APPLICATION

This application is a continuation in part of U.S. patent application Ser. No. 14/864,670 filed Sep. 24, 2015, entitled "Hanger," which claims priority from U.S. Prov. Pat. App. Ser. No. 62/055,812 filed Sep. 26, 2014, entitled "Garment Hanger With Articulating Hook Assembly," the entire specification of which is hereby incorporated by reference in its entirety.

BACKGROUND OF THE DISCLOSURE

1. Field of the Disclosure

The disclosure relates in general to garment hangers, and more particularly, to a hanger that includes a hanger body and a hook assembly. The hook assembly is rotatable relative to the hanger body from a collapsed orientation to an articulated configuration. In the collapsed orientation the hook assembly overlies the hanger body so as to substantially minimally protrude. Such a configuration is well suited for shipping and the like. Additionally, the hook assembly may have the function of a sizer.

2. Background Art

The use of garment hangers is known in the art. Typically, garment hangers include a body assembly and a hook assembly. The hook assembly extends away from the body assembly. A sizer may be coupled to the hook assembly or to the body assembly. Such a hanger is known in the art.

Problematically, such hangers are difficult to ship as the hook member requires a packaging that is typically larger than would otherwise be necessary. In addition, when a sizer is coupled to the hanger, the hanger is complicated to reuse or recycle. That is, the configuration does not lend itself to reuse, shipment, recycling, etc.

It would be desirable to overcome those problems set forth above, as well as to provide additional utility through a garment hanger that includes an articulating hook assembly.

SUMMARY OF THE DISCLOSURE

The disclosure is directed to a hanger. The hanger includes a hanger body, a hook assembly and an attachment assembly. The hanger body includes a first face and a second face opposite the first face, with an internal slot defined therebetween. The internal slot has an upper opening, a lower opening and a first side opening. The hook assembly includes a body having a first face and a second face opposite the first face, and a hook member extending outwardly therefrom. The attachment assembly includes a first coupling component and a second coupling component, the first coupling component is positioned on the hook assembly and the second coupling component is positioned on the hanger body. The first coupling component further includes a central post having a first side extending from the first face of the hook assembly and a second side extending from the second face of the hook assembly. The central post is coupled to an outer rim that is axially spaced apart from the central post by way of a suspension member. The suspension member allows the axial movement of the central post relative to the body of the hook assembly. The second coupling includes a central bore defined by a first opening extending through the first face and a second opening extending through the second face concentric with the first opening and corresponding to the central post. The first side of the central post is insertable into the first opening and the second side of the central post is insertable into the second opening.

In some configurations, the body of the hook assembly further includes a loop member extending therefrom, the loop member positioned opposite the hook member.

In some configurations, the loop member includes a first leg, a second leg and a bottom portion extending therebetween, the first leg extending from a first face of the body of the hook assembly and the second leg extending from a second face of the body.

In some configurations, the first leg and the second leg are substantially parallel to each other with the bottom portion spanning therebetween. The first leg and the second leg are in parallel planes and spaced apart from each other.

In some configurations, the body of the hook assembly is structurally configured to facilitate the placement of a second hook member of a second hanger therethrough, in a configuration wherein the hook member and the second hook member are substantially coplanar.

In some configurations, at least a portion of the loop member is positioned within the inner slot of the hanger body when the hook assembly is in the collapsed configuration. In such a configuration, at least a portion of the loop member extends out of the inner slot of the hanger body, about a lower opening when the hook assembly is in the articulated configuration.

In some configurations, substantially the entirety of the loop member is positioned within the inner slot of the hanger body when the hook assembly is in the collapsed configuration. In such a configuration, at least a portion of the loop member extends out of the inner slot of the hanger body, about a lower opening when the hook assembly is in the articulated configuration.

In some configurations, the hanger further includes a releasable locking component releasably locking the first coupling component and the second coupling component precluding relative rotation therebetween. The releasable locking component releasably locks the hook assembly relative to the hanger body in at least one of the first collapsed configuration and the second articulated configuration.

In some configurations, the releasable locking component is structurally configured to releasably lock the hook assembly relative to the hanger body in each of the first collapsed configuration and the second articulated configuration.

In some configurations, the suspension member further comprises a plurality of connecting arms extending between the central post and the outer rim.

In some configurations, the plurality of connecting arms are spaced apart in a substantially uniform manner about the central post.

In some configurations, the central post has a substantially cylindrical configuration.

In some configurations, in the collapsed configuration, the hook member extends from the internal slot through the first side opening. In the articulated orientation, the hook member extends substantially vertically away from the upper opening of the internal slot.

In some configurations, the suspension member bisects the central post to define the first side and the second side of the central post.

In some configurations, the hook member is integrally formed with the body.

In some configurations, the arcuate distance between the collapsed configuration and the articulated configuration is approximately 90°.

In another aspect of the disclosure, the disclosure is directed to a hanger body, a hook assembly and an attachment assembly. The hanger body has a first face and a second face opposite the first face, with an internal slot defined therebetween. The internal slot has an upper opening. The hook assembly includes a body having a first face and a second face opposite the first face. A hook member extends outwardly therefrom and including an upper curved portion. The attachment assembly includes a first coupling component and a second coupling component. The first coupling component is positioned on the hook assembly and the second coupling component is positioned on the hanger body. The first coupling component further includes a central post having a first side extending from the first face of the hook assembly and a second side extending from the second face of the hook assembly. The central post is coupled to the hook assembly. The second coupling component further including a central bore defined by a first opening extending through the first face and a second opening extending through the second face concentric with the first opening and corresponding to the central post, with the first side of the central post insertable into the first opening and the second side of the central post insertable into the second opening. Through the attachment assembly, the first coupling component and the second coupling component facilitate relative rotation therebetween. A releasable locking component releasably locks the first coupling component and the second coupling component precluding relative rotation therebetween. The releasable locking component releasably locks the hook assembly relative to the hanger body in a first collapsed configuration and a second articulated configuration.

BRIEF DESCRIPTION OF THE DRAWINGS

The disclosure will now be described with reference to the drawings wherein.

DETAILED DESCRIPTION OF THE DISCLOSURE

Figure 1:
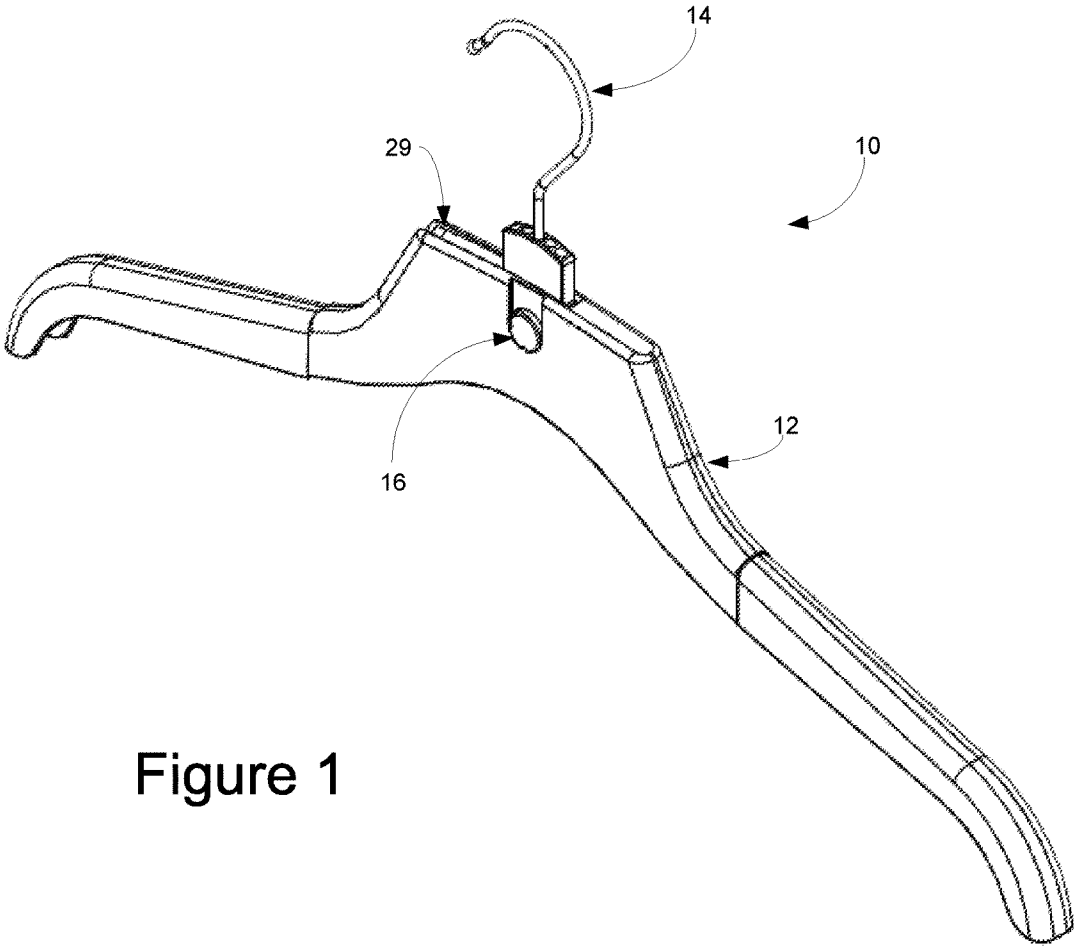
FIG. 1 of the drawings is a perspective view of the hanger of the present disclosure, showing, in particular the hook assembly in the articulated configuration.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
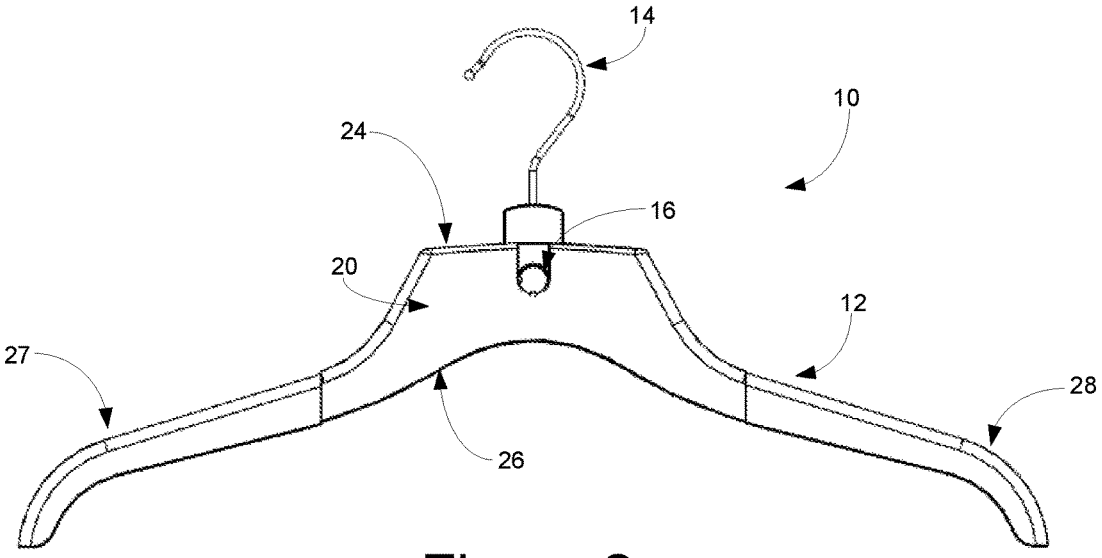
FIG. 2 of the drawings is a front elevational view of the hanger of the present disclosure, showing, in particular the hook assembly in the articulated configuration.
Figure 3:
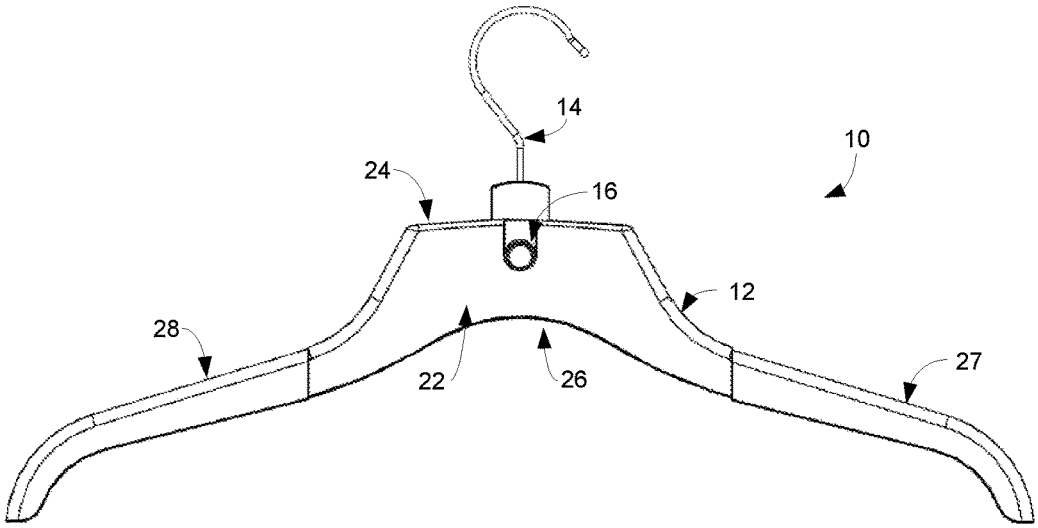
FIG. 3 of the drawings is a back elevational view of the hanger of the present disclosure, showing, in particular the hook assembly in the articulated configuration.

Referring now to the drawings and in particular to FIGS. 1 through 3, collectively, the hanger of the present disclosure is shown generally at 10. It will be understood and explained below that the hanger 10 comprises hanger body 12, hook assembly 14 and attachment assembly 16. The hanger it will be understood may have additional structures (not shown) for engaging various clothing portions, including but not limited to clips, clasps, frictional clothing engagement fingers, spaghetti strap retaining openings. Some such structures are shown in U.S. Pat. Nos. 7,506,785 and 7,464,841, both of which are issued to Hansen, et al, both of which are incorporated herein in their entirety by reference, as well as the patents cited therein. Generally, the hanger is configured for collapsing and articulating the hook from a stowed orientation to a deployed orientation. Such a hanger is well suited for shipping. Additionally, the components can be shipped separately and assembled as desired at locations remote of the manufacture thereof Furthermore, the hook assembly may integrally include or have the additional function of a garment sizer.

The hanger body is shown in FIGS. 1 through 3 and 9 through 10 as comprising first face 20 and second face 22, as well as a top end 24, bottom end 26, first side 27 and second side 28. Generally, the hanger body comprises a molded polymer member. Additionally, an internal slot 29 is defined in the hanger body between the first side and the second side. The internal slot includes upper opening 30 and lower opening 32. Further, a first side opening 33 extends from the upper opening on the first side thereof so as to define a continuous opening at the top end 24. The internal slot further defines a first face inner surface 36 and a second face inner surface 38. In the configuration shown, the first face inner surface and the second face inner surface are substantially parallel to each other and spaced apart from each other a predetermined distance. It will be understood that either one of the first face and the second face may comprise the generally outwardly facing face. As such, the second face may be the outward face or the first face may be the outward face.

In the configuration shown, the hanger body generally forms what is often referred to as an uppers hanger; that is, a hanger configured for upper body garments. As such, the garment typically has a larger central body with opposing ends being tapered and generally extending in a downward direction. Of course variations are contemplated. In addition, the first and second ends may have structures such as slots, spaghetti strap holders and the like. Further, friction type devices or surfaces may be applied to the first and second end to help maintain clothing in the proper configuration. It is additionally contemplated that the hanger body may be integrally formed, or the central region may comprise a first component with each end being a separate attachable component. It will be understood that the principles of the present disclosure, while generally shown in association with an upper garment hanger, are equally applicable to a lower body garment hanger.

Figure 4:
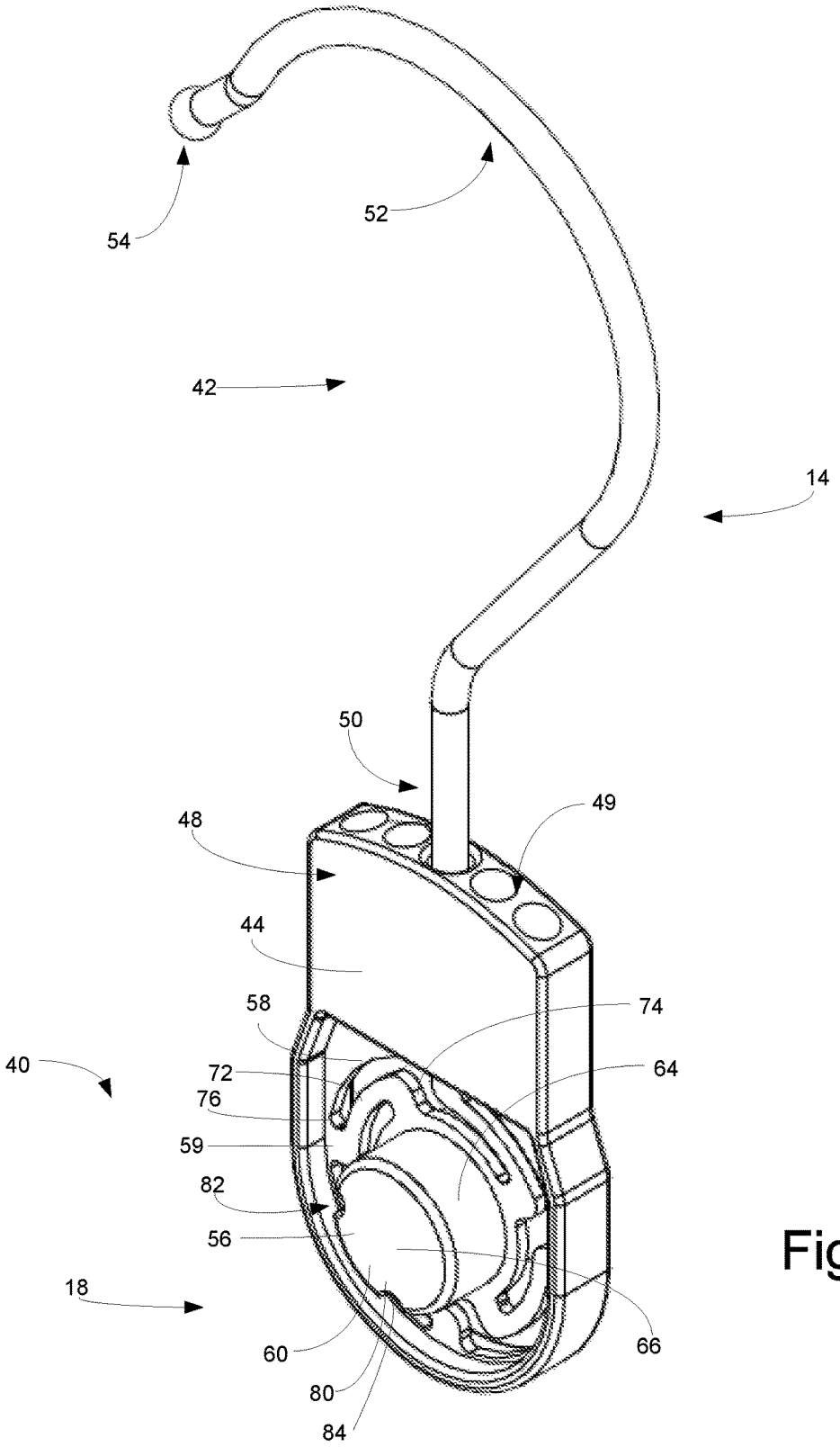
FIG. 4 of the drawings is a perspective view of the hook assembly of the present disclosure.
Figure 5:
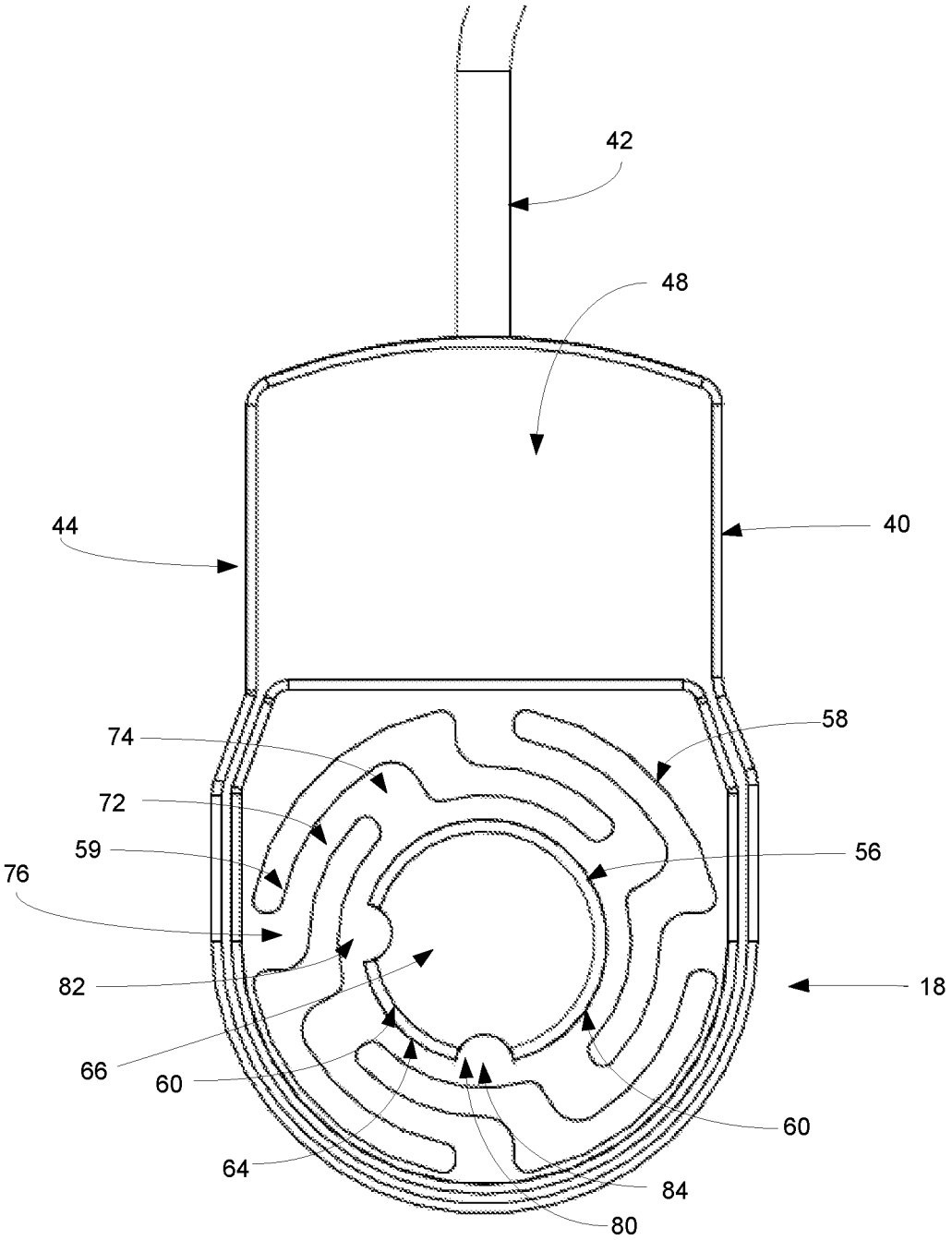
FIG. 5 of the drawings is a partial front elevational view of the hook assembly, showing, the body of the hook assembly.
Figure 6:
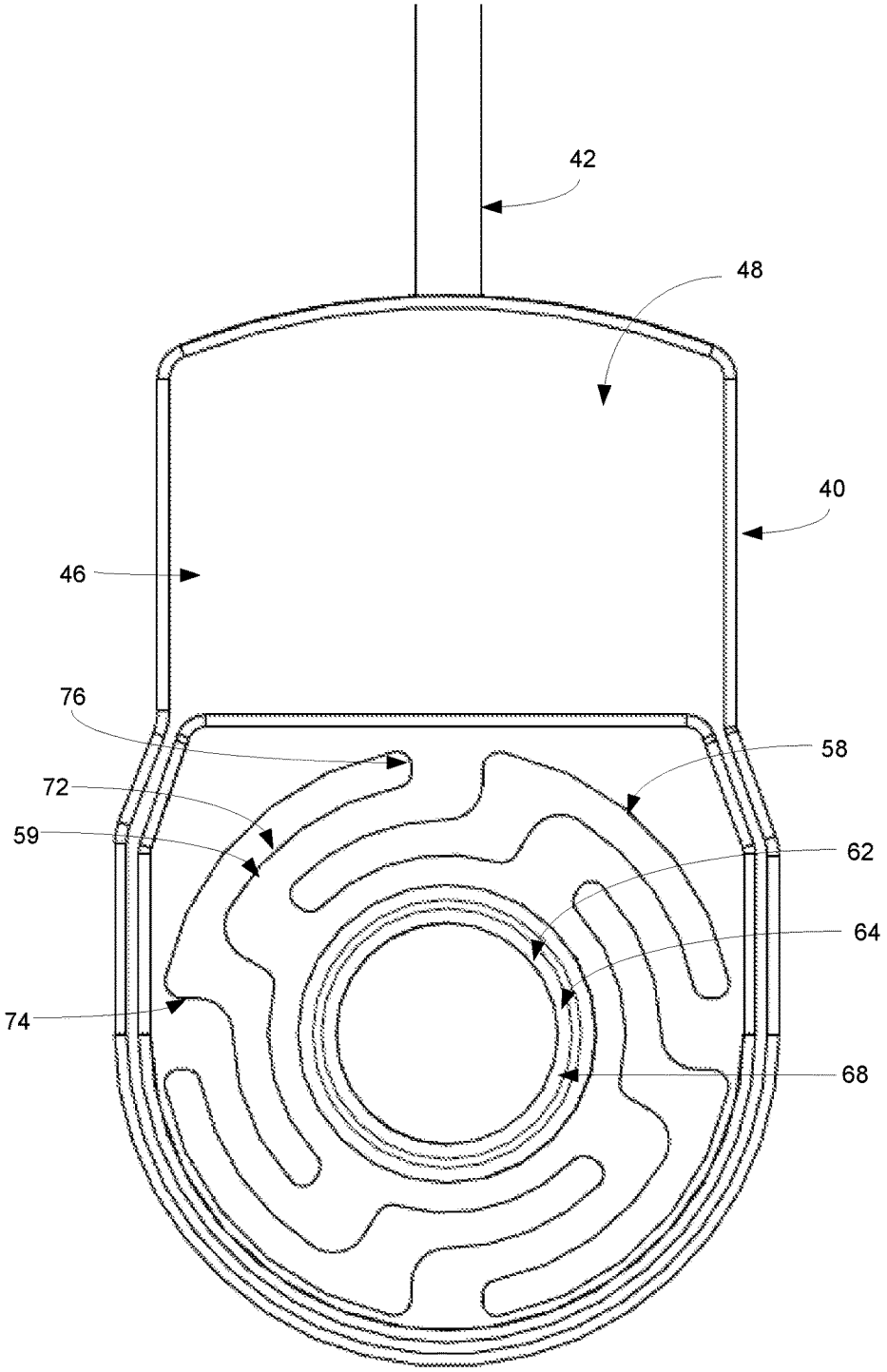
FIG. 6 of the drawings is a partial back elevational view of the hook assembly, showing, the body of the hook assembly.
Figure 8:
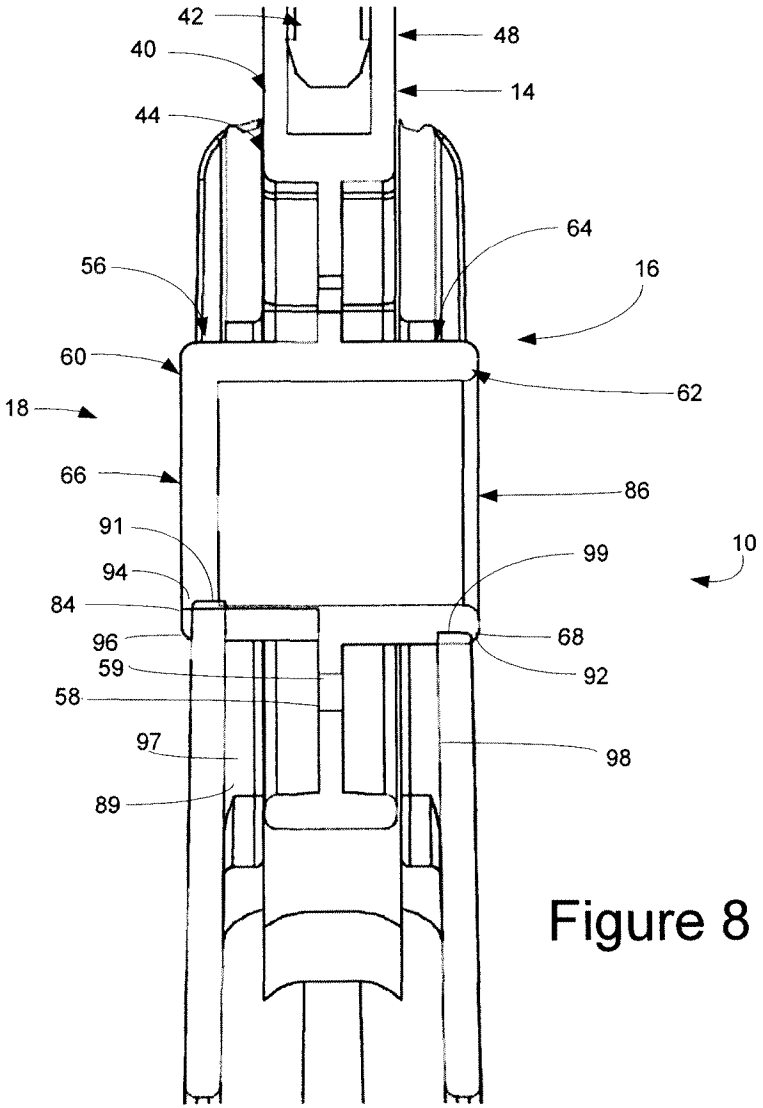
FIG. 8 of the drawings is a partial cross-sectional view of the hanger showing, in particular, the interaction of the first coupling member and the second coupling member.
Figure 7:
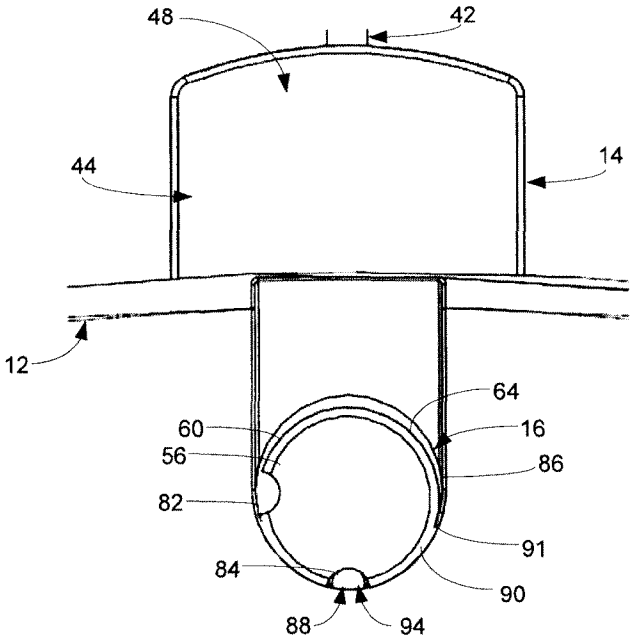
FIG. 7 of the drawings is a partial front elevational view of the hanger showing, in particular, the interaction of the first coupling member and second coupling member at the front face of the hanger body.
Figure 10:
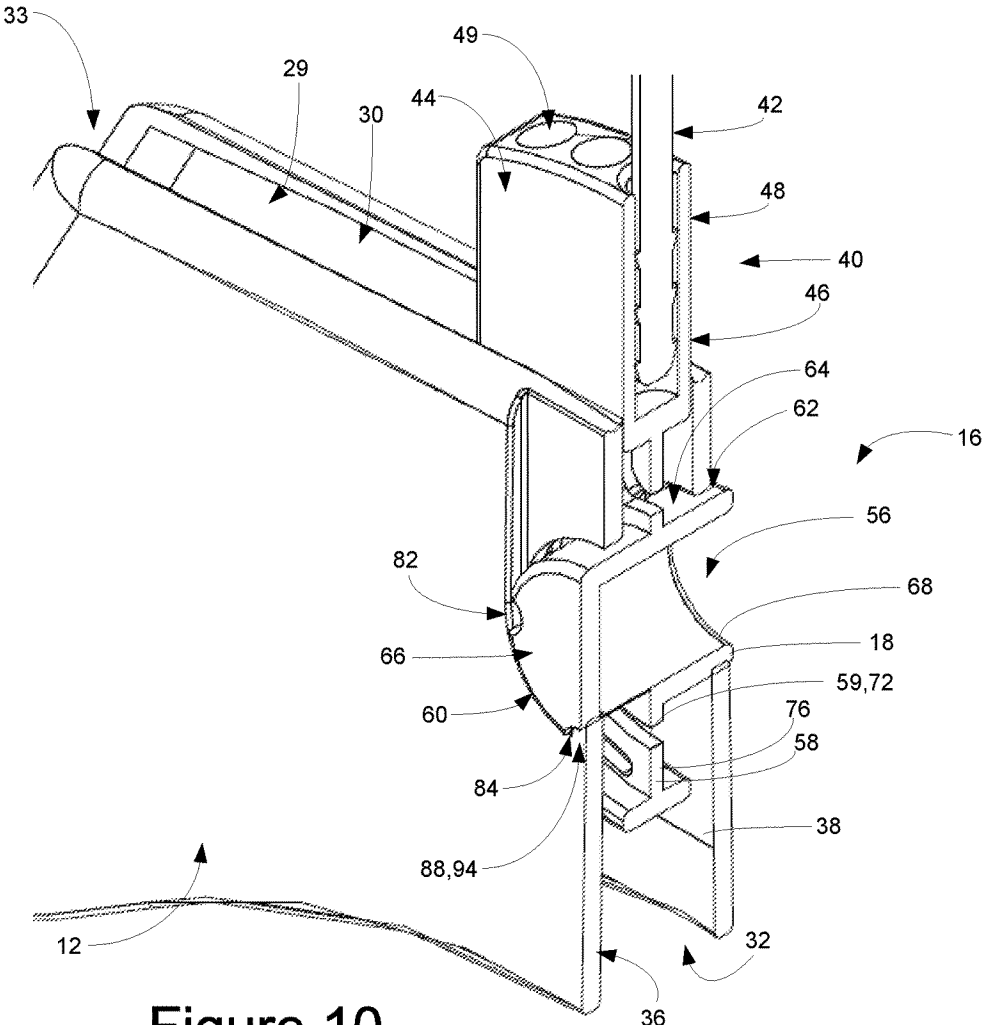
FIG. 10 of the drawings is a partial perspective cross-sectional view of the hanger showing, in particular, the intersection of the first coupling member and the second coupling member.
Figure 9:
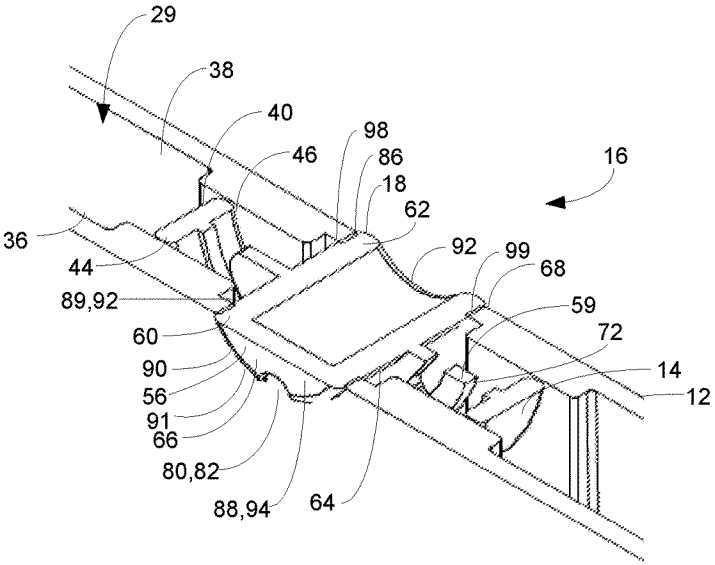
FIG. 9 of the drawings is a partial perspective cross-sectional view of the hanger showing, in particular, the interaction of the first coupling member and the second coupling member.

The hook assembly 14 is shown in FIGS. 4 through 6 as comprising body 40 and hook member 42. The body 40 includes first face 44, second face 46 and upper boss portion 48. Preferably, the body comprises a molded member, such as an injection molded polymer member. First face 44 and second face 46 are generally parallel to each other and spaced apart from each other to define a thickness and an outer perimeter. The boss portion may form a sizer, wherein indicia is applied to one or both of the outward side and the inward side that references the size of the garment (i.e., S, M, XL, a number such as 12, 14, 16, 36, 38, 40, among others). Depending on the particular configuration, the perimeter, or thickness between the outward side and the inward side may allow for indicia along the thickness therebetween. It will further be understood that while the outward side and the inward side are shown as being substantially planar, other configurations are contemplated, such as, for example, configurations wherein the sides may have surface variations, which results in varying thicknesses for the body.

Figure 14:
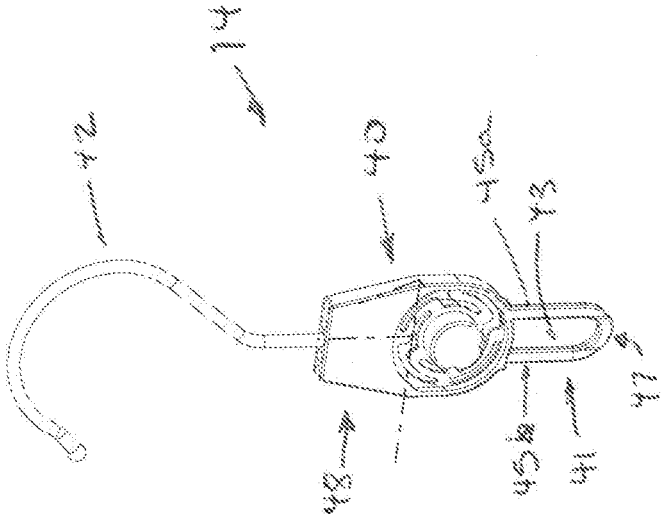
FIG. 14 of the drawings is a perspective view of a second configuration of a hook assembly showing the loop member.
Figure 15:
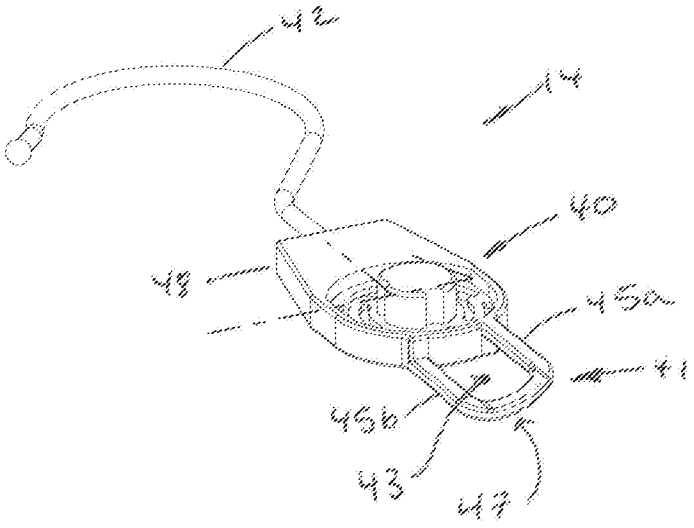
FIG. 15 of the drawings is a perspective view of the second configuration of a hook assembly, showing the loop member and the configuration thereof.
Figure 16:
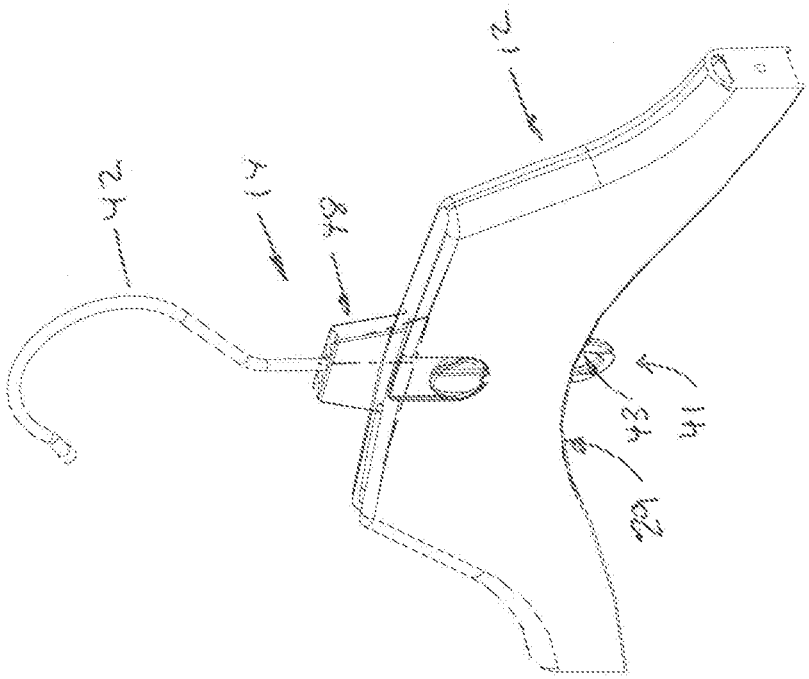
FIG. 16 of the drawings is a partial perspective view of a hanger showing, in particular, a second configuration of the hook assembly including a loop member in the articulated configuration, with the understanding that the collapsed orientation from the outside appears indistinguishable from that which is shown in FIG. 11 or 13 wherein the hook member is integrally molded with the body.

In another configuration, shown in FIGS. 14 through 16, the body 40 of the hook assembly 14 may further include a loop member 41 which defines opening 43. The loop member 41 extends downwardly away from a lower end of the body 40 opposite the upper boss portion 48. The loop member 41 is configured to be folded into the internal slot 29 of the hanger body when the hook assembly is in a collapsed position, so that the hook member, and the curved portion thereof. When the hook assembly 14 is articulated into the articulated configuration, the loop member extends out of the lower opening of the of the internal slot so as to exit out from therewithin. As will be understood a second hanger hook member can be extended through the opening 43 of the loop member 41 so as to hang from the loop member.

In the configuration shown, the loop member is in the same plane as the body 40 but one leg 45*a* extends from the first face while the other leg 45*b* extends from the second face, with the bottom portion 47 of the loop member straddling therebetween, with the legs of the loop member are substantially parallel to each other and spaced apart both side to side and front to back. As such, a hanger that is inserted therethrough can be positioned so as to be substantially parallel to the hook member. In other configurations, the hook member inserted through the opening defined by the loop member may be perpendicular or otherwise oblique to the hook member 42 and/or the hanger body. The use of the loop member is preferably such that when collapsed, the entirety of the loop member remains within the internal slot 29. In other configurations, the loop member may extend outside of the loop member regardless of whether the hook assembly is in the articulated or collapsed configuration. In the configuration shown, the loop member comprises an elongated loop that is parallel to the front and back face of the body of the hook assembly.

Figure 12:
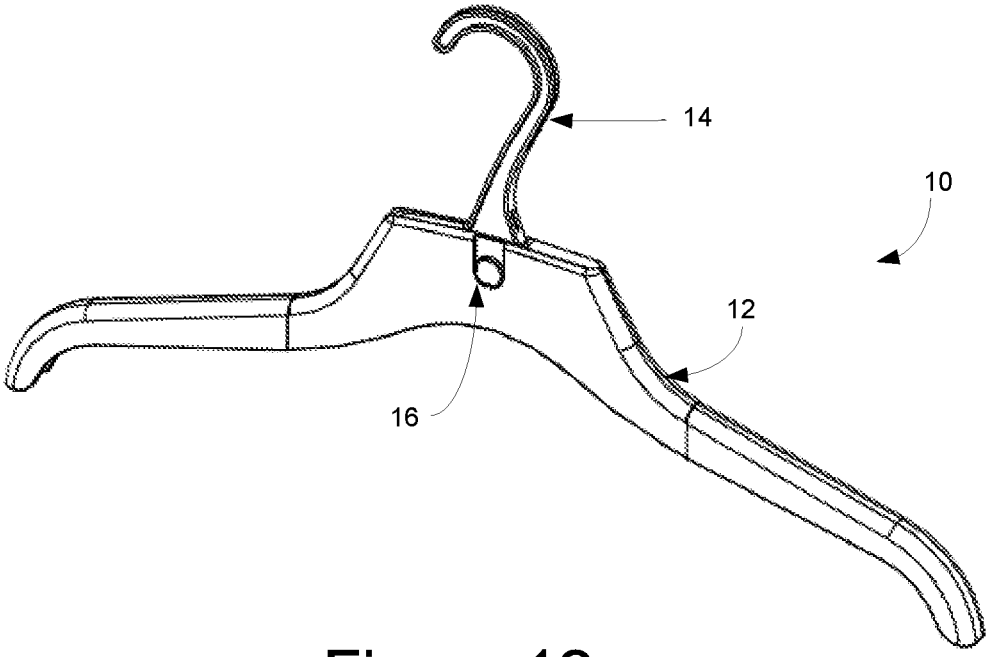
FIG. 12 of the drawings is a perspective view of a hanger showing, in particular, the articulated configuration and an integrally formed hook assembly body and hook member.

The hook member 42 extends from the top end 49 of the body 40 and includes lower end 50, upper curved portion 52 and end tip 54. In the configuration shown, the hook member comprises a metal member of a substantially uniform diameter that is shaped into the configuration shown. Generally, the curved portion is configured to extend around a pole or other elongated member, and variations in shape are contemplated. In many such embodiments, the end tip may include an additional formation, such as, for example a sphere or a bent portion or the like. In other configurations, such as the configuration shown in FIGS. 12 and 13, the hook member may be integrally formed with the body 40 and may likewise comprise a polymer member. In such a configuration, typically, the hook member may comprise an I-beam construction or the like. In other configurations, the hook member may comprise a cylindrical cross-section, a square cross section or another shape.

The attachment assembly 16 is shown as comprising first coupling component 18 and second coupling component 19. In the configuration shown, the first coupling component is formed on the hook assembly 14 and the second coupling component is formed on the hanger body 12. It will be understood that in other configurations portions of each may be interchanged between the hook assembly and the hanger body.

The first coupling component is shown in FIGS. 4 through 6 and FIGS. 7 through 10 as comprising central post 56, outer rim 58, suspension member 59 and first releasable locking component 80. The central post 56 extends generally perpendicular to the first and second faces 44, 46 of the body 40 of the hook assembly 14, and to either side thereof. As such, the first side 60 of the central post protrudes beyond the first face 44 (which may include a thinner section of the body 40). The second side 62 of the central post protrudes beyond the second face 46 a predetermined distance. In the configuration shown, the central post is generally centrally located within the body 40 below the upper boss portion 48. The first side 60 terminates with a first side top surface 66 and the second side 62 terminates with the second side terminating surface 68 (in the configuration shown, a rim and cavity). In the configuration shown, the central post is a substantially uniform cylindrical configuration having an outer surface 64 extending therearound. The body 40 essentially bisects the central post so that approximately half defines the first side and half defines the second side.

An outer rim 58 defined in the body and axially spaced apart from the central post is defined, with suspension members 59 coupling the central post to the outer rim, and in turn, the body 40. The suspension members include connecting arms 72 each having a first end 74 attached to the central post (through an extending flange that extends axially about the central post) and a second end 76 that is coupled to the body at the outer rim 58. In the configuration shown, the connecting arms 72 have an arcuate configuration so as to render connecting arms that are larger than the distance between the central post and the outer rim. A total of four connecting arms are positioned about the central post and they are substantially evenly distributed and spaced apart from each other. In the configuration shown, each of the connecting arms are substantially identical in configuration. As will be explained below, the connecting arms allow for axial (i.e., inward and outward) movement of the central post relative to the body 40 of the hook assembly.

In another configuration, the central post may be fixed relative to the outer rim, and, in turn, the body 40. As such, the central post still defines the axis of rotation, however, the stops or predetermined collapsed and articulated configurations can be determined by interfacing of the body 40 of the hook assembly 14 with the hanger body 12. For example, the body 40 my include a tab or other structure which can interface with the hanger body 12 (typically within the internal slot 29) in each of, or at least one of, the collapsed and articulated configurations. As such, the user merely applies force to hook assembly to overcome the stop or to move in a direction opposite the stop to direct the hook assembly into the desired configuration. As the hanger body has some flexibility, the force exerted on a stop can be translated into elastic deformation of the hanger body, to, in turn, allow for the relative rotation of the hook assembly relative to the hanger body.

The first releasable locking component 80 is shown as comprising a first indent 82 and a second indent 84. The first releasable locking component, as will be explained below is configured to interface with the second releasable locking component 88 so as to releasably retain the hook member in one of a collapsed configuration and an articulated configuration. The indents are substantially semi-circular in configuration with substantially uniform cross-sectional configurations. The first and second indents 82, 84 are spaced apart from each other by approximately 90° and denote the rotational travel of the hook assembly relative to the hanger body.

The second coupling component 19 includes central bore 86, second releasable locking component 88 and insertion rail 89. The second coupling component is disposed on the hanger body and includes first opening 90 and second opening 92. The two openings are concentric and are sized so as to substantially correspond to the central post, so that the central post is slidably positioned therein. The first opening includes perimeter 91 and is defined on the first face 20. The second opening includes perimeter 99 and is defined on the second face 22. The two openings are spaced apart from the openings of the internal slot 29 of the hanger body. Further it is contemplated that the first side opening 33 and the second side opening 34 flank the central bore on either side thereof.

The second releasable locking component 88 includes first detent 94. The detent extends axially inwardly from the perimeter 91 of the first opening 90 and is shaped so as to correspond to the shape of the first and second indents 82, 84. In the configuration shown, the first detent 94 is positioned at the lowermost region of the first opening. Of course, variations are contemplated.

The insertion rail 89 comprises a structure that is disposed on the first face inner surface 36 and the second face inner surface 38. The rails are positioned below the respective first and second openings 90, 92 of the central bore and form a guide along which the central post can be directed from below the openings to a position wherein the central post will extend through the opposing openings 90, 92.

To assemble the hanger of the present disclosure, the hanger body 12 is provided and the hook assembly 14 is provided. In the configuration shown, the hook member comprises a metal member over which the body 40 is molded. In many such configurations, the hook member can rotate on its axis relative to the body 40. To initiate assembly, the hook member is positioned so as to be substantially coplanar with the body 40. In other configurations, where the two components are integrally formed, coupled or molded, such additional repositioning of one relative to the other is not required.

Initially, the hook assembly is inserted into the internal slot 29 through the lower opening 32 thereof. The hook assembly 14 is inserted therein with the hook member 42 leading. Continued insertion directs the hook member 42 out of the internal slot. Further continued movement directs the body of the hook assembly into the internal slot through the lower opening. As the internal slot is narrower than the central post, as the post enters the internal slot, the first face 20 and the second face 22 are pushed outwardly by the central post.

Eventually, the central post is directed to the insertion rail 89 and the first side 60 of the central post enters in the first side insertion rail 97. At the same time, the second side 62 of the central post enters the second side insertion rail 98. Continued pulling through the internal slot eventually pulls the central post along the insertion rail toward the central bore.

Once the central bore is reached, the second side 62 exits through the second opening 92. Inasmuch as the shape of the central post corresponds to the shape of the central bore, the central post along with the hook assembly rotates within the central bore relative thereto and relative to the hanger body.

Due to the first detent extending into the first opening 90 inward from the perimeter 91, unless the first detent is lined up with the first indent 82 or the second indent 84, the structures remain uncoupled In the event that it is not, the first face may press against the first side of the central post. In such a configuration, the suspension member may cause the central post to move relative to the body of the hook assembly to accommodate the lack of passage of the first side of the central post through the first opening 90.

The user can then rotate the hook assembly along the interface between the second side 62 of the central post and the second opening 92. Rotation can continue until either the collapsed configuration is reached wherein the detent 94 will line up with the first indent 82. Once these two structures line up, the suspension member, being biased by the pressing of the first side of the central post against the first face inner surface of the slot, will return to its original configuration, and urge the first side 60 of the central post into the first opening.

Similarly, the rotation could have been initiated in the opposite direction until the detent 94 lines up with the second indent 84 at which time the suspension member would urge the first side into the first opening 90. The resulting configuration is the fully articulated configuration.

Once in either configuration, the interference between the detent and the respective indent precludes relative rotation of the hook assembly relative to the hanger body. That is, generally, without deforming or breaking the two structures, the hook assembly will not rotate relative to the hanger body about the central post and the central bore.

To alter the position from one of the articulated configuration and the collapsed configuration, the user first depresses the central post 56 about the first side top surface 66 until the first side 60 is pushed out of the first opening 90 and into the internal slot. Once pushed out of the first opening 90, the detent 94 is decoupled from the respective one of the first and second indent. The hook assembly can now be rotated until the detent 94 and the other one of the respective first and second indents line up with the detent. At such time, the suspension member will direct the first side 60 of the central post back into the first opening 90, again releasably locking the hook assembly relative to the hanger body.

Figure 11:
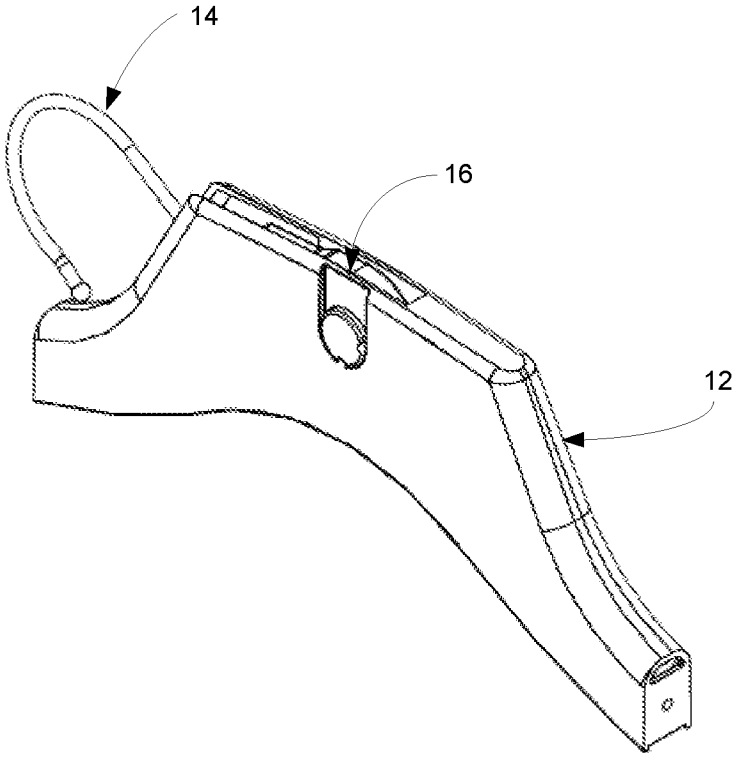
FIG. 11 of the drawings is a partial perspective view of the hanger showing, in particular, the collapsed configuration.
Figure 13:
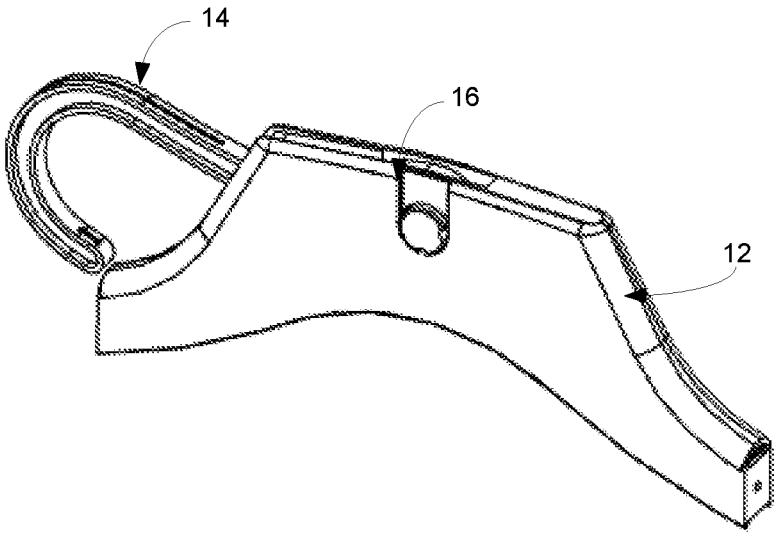
FIG. 13 of the drawings is a partial perspective view of a hanger showing, in particular, the collapsed configuration and an integrally formed hook assembly body and hook member.

It will be understood that in the articulated configuration, the hook member extends substantially vertically out of the internal slot and away from the upper opening. Such a configuration is shown in FIGS. 1 through 3 and 12. In the collapsed configuration, the hook member is rotated a quarter turn with the hook member extending through the first side opening 33 of the internal slot so a minimal portion, if any, of the hook member extends beyond the top end of the hanger body. In such a configuration, the garment can be shipped with minimal wasted space or interference from the hook member. Once the user receives a garment on the hanger when the hanger is in the collapsed configuration, the user depresses the first side top surface 66 of the central post driving the central post out of the first opening of the central bore and disconnecting the detent 94 from the first indent 82. The hook assembly can then be rotated relative to the hanger body. Once the detent 94 aligns with the second indent 84, the first side of the central post re-enters the first opening. The two components are again substantially locked relative to rotation of the hook assembly and the hanger body. Such an articulated configuration is shown in FIGS. 11 and 13.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A hanger comprising:

a hanger body having a first face and a second face opposite the first face, with an internal slot defined therebetween, the internal slot having an upper opening;

a hook assembly including a body having a first face and a second face opposite the first face, and a hook member extending outwardly therefrom and including an upper curved portion; and an attachment assembly including a first coupling component and a second coupling component, the first coupling component positioned on the hook assembly and the second coupling component positioned on the hanger body, the first coupling component further including a central post having a first side extending from the first face of the hook assembly and a second side extending from the second face of the hook assembly, the central post coupled to an outer rim that is axially spaced apart from the central post by way of a suspension member, the suspension member allowing the axial movement of the central post relative to the body of the hook assembly; and the second coupling component further including a central bore defined by a first opening extending through the first face and a second opening extending through the second face concentric with the first opening and corresponding to the central post, with the first side of the central post insertable into the first opening and the second side of the central post insertable into the second opening, wherein through the attachment assembly, the first coupling component and the second coupling component facilitate relative rotation therebetween, so as to facilitate placement of the hook between a first collapsed configuration and a second articulated configuration, wherein the curved portion of the hook member is closer to the hanger body in the first collapsed configuration, and further from the hanger body in the second articulated configuration.

2. The hanger of claim 1 wherein the body of the hook assembly further includes a loop member extending therefrom, the loop member positioned opposite the hook member.

3. The hanger of claim 2 wherein the Loop member includes a first leg, a second leg and a bottom portion extending therebetween, the first leg extending from a first face of the body of the hook assembly and the second leg extending from a second face of the body.

4. The hanger of claim 3 wherein the first leg and the second leg are substantially parallel to each other with the bottom portion spanning therebetween, wherein the first leg and the second leg are in parallel planes and spaced apart from each other.

5. The hanger of claim 2 wherein the body of the hook assembly is structurally configured to facilitate the placement of a second hook member of a second hanger therethrough, in a configuration wherein the hook member and the second hook member are substantially coplanar.

6. The hanger of claim 2 wherein at least a portion of the loop member is positioned within the inner slot of the hanger body when the hook assembly is in the collapsed configuration, and wherein at least a portion of the loop member extends out of the inner slot of the hanger body, about a lower opening when the hook assembly is in the articulated configuration.

7. The hanger of claim 2 wherein substantially the entirety of the loop member is positioned within the inner slot of the hanger body when the hook assembly is in the collapsed configuration, and wherein at least a portion of the loop member extends out of the inner slot of the hanger body, about a lower opening when the hook assembly is in the articulated configuration.

8. The hanger of claim 1 further comprising a releasable locking component releasably locking the first coupling component and the second coupling component precluding relative rotation therebetween, the releasable locking component releasably locking the hook assembly relative to the hanger body in at least one of the first collapsed configuration and the second articulated configuration.

9. The hanger of claim 8 wherein the releasable locking component is structurally configured to releasably lock the hook assembly relative to the hanger body in each of the first collapsed configuration and the second articulated configuration.

10. The hanger of claim 1 wherein the suspension member further comprises a plurality of connecting arms extending between the central post and the outer rim.

11. The hanger of claim 10 wherein the plurality of connecting arms are spaced apart in a substantially uniform manner about the central post.

12. The hanger of claim 11 wherein the central post has a substantially cylindrical configuration.

13. The hanger of claim 12 wherein in the collapsed configuration, the hook member extends from the internal slot through the first side opening, and wherein in the articulated orientation, the hook member extends substantially vertically away from the upper opening of the internal slot.

14. The hanger of claim 11 wherein the suspension member bisects the central post to define the first side and the second side of the central post.

15. The hanger of claim 1 wherein the hook member is integrally formed with the body.

16. The hanger of claim 1 wherein the arcuate distance between the collapsed configuration and the articulated configuration is approximately 90°.

* * * * *